US009151521B2

(12) United States Patent
Bittner

(10) Patent No.: US 9,151,521 B2
(45) **Date of Patent: *Oct. 6, 2015**

(54) FREE COOLING CASCADE ARRANGEMENT FOR REFRIGERATION SYSTEM

(75) Inventor: John D. Bittner, Bethlehem, GA (US)

(73) Assignee: Hill Phoenix, Inc., Conyers, GA (US)

( * ) Notice: Subject to any disclaimer, the term of this patent is extended or adjusted under 35 U.S.C. 154(b) by 860 days.

This patent is subject to a terminal disclaimer.

(21) Appl. No.: 13/051,982

(22) Filed: Mar. 18, 2011

(65) Prior Publication Data

US 2011/0167847 A1 Jul. 14, 2011

Related U.S. Application Data

(63) Continuation-in-part of application No. 12/107,644, filed on Apr. 22, 2008, now Pat. No. 7,913,506.

(51) Int. Cl.
*F25B 5/02* (2006.01)
*F25B 7/00* (2006.01)

(52) U.S. Cl.
CPC ..... *F25B 7/00* (2013.01); *F25B 2339/047* (2013.01); *F25B 2400/22* (2013.01)

(58) Field of Classification Search
USPC ..... 62/246–256, 175, 332–335, 430–439
See application file for complete search history.

(56) References Cited

U.S. PATENT DOCUMENTS 2,930,593 A 3/1960 Blum
3,708,030 A * 1/1973 Ueda ..... 180/406
5,335,508 A * 8/1994 Tippmann ..... 62/129
5,970,729 A 10/1999 Yamamoto et al.
6,094,925 A * 8/2000 Arshansky et al. ..... 62/81
6,170,270 B1 1/2001 Arshansky et al.
6,170,272 B1 1/2001 Backman (Continued)

FOREIGN PATENT DOCUMENTS

EP 0340115 * 4/1989
EP 0340115 * 9/2004 ..... F25B 5/02

(Continued)

OTHER PUBLICATIONS

"Experiences from CO2 Installations," York Refrigeration, May 24, 2001, 1 pp.

(Continued)

*Primary Examiner* — Frantz Jules
*Assistant Examiner* — Martha Tadesse
(74) *Attorney, Agent, or Firm* — Foley & Lardner LLP

(57) ABSTRACT

A refrigeration system includes a medium temperature subsystem circulating a coolant in a closed loop between at least one medium temperature chiller and at least one medium temperature load and at least one cascade heat exchanger, and a low temperature subsystem circulating a coolant in a closed loop between at least one low temperature heat exchanger and at least one low temperature load. A cooling circuit is provided for circulating a coolant and includes a first pump and a second pump and a fluid cooler and a valve, and interfaces with the medium temperature chiller and the low temperature chiller. The valve is movable to a closed position to define a first flow path and a second flow path, where the first flow path includes the first pump and the medium temperature chiller and fluid cooler, and the second flow path including the second pump and the low temperature heat exchanger and the cascade heat exchanger.

26 Claims, 6 Drawing Sheets

(56) References Cited

U.S. PATENT DOCUMENTS

| | | | | |
|---|---|---|---|---|
| 6,202,425 | B1 | 3/2001 | Arshansky et al. | |
| 6,502,412 | B1 | 1/2003 | Dubé | |
| 6,640,561 | B2 * | 11/2003 | Roberto | 62/96 |
| 6,708,511 | B2 | 3/2004 | Martin | |
| 6,820,434 | B1 | 11/2004 | Gutheim et al. | |
| 6,826,918 | B1 | 12/2004 | Taras et al. | |
| 6,871,509 | B2 | 3/2005 | Grabon et al. | |
| 6,955,059 | B2 | 10/2005 | Lifson et al. | |
| 6,968,708 | B2 | 11/2005 | Gopalnarayanan et al. | |
| 6,973,794 | B2 | 12/2005 | Street et al. | |
| 7,036,330 | B2 | 5/2006 | Grabon et al. | |
| 7,114,349 | B2 | 10/2006 | Lifson et al. | |
| 7,159,413 | B2 | 1/2007 | Dail | |
| 7,913,506 | B2 | 3/2011 | Bittner et al. | |
| 8,516,838 | B1 * | 8/2013 | Papagna | 62/113 |
| 2002/0023447 | A1 * | 2/2002 | Podtchereniaev et al. | 62/217 |
| 2004/0031280 | A1 * | 2/2004 | Martin et al. | 62/246 |
| 2005/0198997 | A1 | 9/2005 | Bush | |
| 2006/0005571 | A1 | 1/2006 | Lifson et al. | |
| 2006/0010907 | A1 | 1/2006 | Taras et al. | |
| 2006/0010908 | A1 | 1/2006 | Taras et al. | |
| 2006/0042311 | A1 | 3/2006 | Esslinger | |
| 2006/0117773 | A1 | 6/2006 | Street et al. | |
| 2008/0148744 | A1 * | 6/2008 | Al-Maaitah | 62/98 |
| 2008/0289350 | A1 * | 11/2008 | Shapiro | 62/246 |
| 2009/0025404 | A1 | 1/2009 | Allen | |
| 2009/0120117 | A1 * | 5/2009 | Martin et al. | 62/246 |
| 2009/0260381 | A1 * | 10/2009 | Bittner et al. | 62/255 |
| 2009/0260389 | A1 | 10/2009 | Dube | |
| 2009/0272128 | A1 * | 11/2009 | Ali | 62/56 |
| 2009/0293517 | A1 | 12/2009 | Bittner | |
| 2009/0293523 | A1 | 12/2009 | Bittner et al. | |
| 2010/0023166 | A1 | 1/2010 | Chessel et al. | |
| 2010/0023171 | A1 | 1/2010 | Bittner et al. | |
| 2010/0031697 | A1 * | 2/2010 | Hinde et al. | 62/498 |
| 2010/0036530 | A1 | 2/2010 | Chessel et al. | |
| 2010/0036531 | A1 | 2/2010 | Chessel et al. | |
| 2010/0042265 | A1 | 2/2010 | Rigal et al. | |
| 2010/0050669 | A1 | 3/2010 | Poux et al. | |
| 2010/0070082 | A1 | 3/2010 | Chessel et al. | |
| 2010/0070088 | A1 | 3/2010 | Josserand et al. | |
| 2010/0205984 | A1 | 8/2010 | Gu et al. | |
| 2011/0061419 | A1 * | 3/2011 | Martin et al. | 62/335 |
| 2011/0154840 | A1 | 6/2011 | Mihara et al. | |
| 2012/0117996 | A1 * | 5/2012 | Hinde et al. | 62/192 |

FOREIGN PATENT DOCUMENTS

| | | | |
|---|---|---|---|
| EP | 1452808 A2 * | 9/2004 | F25B 5/02 |
| WO | WO 2011/049767 | 4/2011 | |

OTHER PUBLICATIONS

International Search Report and Written Opinion for International Application No. PCT/US2012/065522, mail date Feb. 8, 2013, 10 pages.

Margaux Drawing CU2015 PA, dated Sep. 27, 1989, 1 page.

* cited by examiner

FREE COOLING CASCADE ARRANGEMENT FOR REFRIGERATION SYSTEM

CROSS REFERENCE TO RELATED APPLICATIONS

The present application claims the benefit of priority as a continuation-in-part of U.S. patent application Ser. No. 12/107,644 titled "Free Cooling Cascade Arrangement For Refrigeration System" filed on Apr. 22, 2008, the disclosure of which is hereby incorporated by reference in its entirety.

BACKGROUND

The present invention relates to a refrigeration system with a low temperature portion and a medium temperature portion. The present invention relates more particularly to a refrigeration system where the low temperature portion may receive condenser cooling from refrigerant in the medium temperature portion in a cascade arrangement, or may share condenser cooling directly with the medium temperature system.

Refrigeration systems typically include a refrigerant that circulates through a series of components in a closed system to maintain a cold region (e.g., a region with a temperature below the temperature of the surroundings). One exemplary refrigeration system is a vapor refrigeration system including a compressor. Such a refrigeration system may be used, for example, to maintain a desired temperature within a temperature controlled storage device, such as a refrigerated display case, coolers, freezers, etc. The refrigeration systems may have a first portion with equipment intended to maintain a first temperature (such as a low temperature) and a second temperature (such as a medium temperature). The refrigerant in the low temperature portion and the refrigerant in the medium temperature portion are condensed in condensers which require a source of a coolant.

If the outside temperature is cold enough, an outdoor heat exchanger such as a cooling tower or a fluid cooler may be used as a part of the refrigeration system to provide a source of cooling for the condensors. Such an arrangement is often called a "free cooling" arrangement because the system does not need to operate an additional compressor. However, if the exterior air is not sufficiently cold, an exterior heat exchanger may not provide sufficient cooling for some systems.

SUMMARY

One embodiment of the invention relates to a refrigeration system, including medium temperature compact chiller units arranged in parallel and configured to cool a medium temperature liquid coolant for circulation to medium temperature refrigerated display cases, and low temperature heat exchangers arranged in parallel and configured to cool a low temperature coolant or refrigerant for circulation to low temperature refrigerated display cases. A coolant supply header supplies a coolant to the medium temperature compact chiller units and the low temperature heat exchanger. A coolant suction header receives the coolant from the medium temperature compact chiller units and the low temperature heat exchanger. A fluid cooler cools the coolant in the coolant supply header. A cascade heat exchanger receives a supply of the medium temperature liquid coolant from the medium temperature compact chiller units. A pump is configured to pump the coolant from the coolant suction header to the coolant supply header and through the fluid cooler. Another pump is configured to pump the coolant from the coolant suction header to the coolant supply header and through the cascade heat exchanger. A valve on the coolant supply header between the low temperature heat exchanger and the medium temperature compact chiller units is movable to a closed position to define one cooling flow path comprising the first pump and the fluid cooler and the medium temperature modular chiller units, and another cooling flow path comprising the second pump and the cascade heat exchanger and the low temperature heat exchanger.

DETAILED DESCRIPTION

Figure 1:
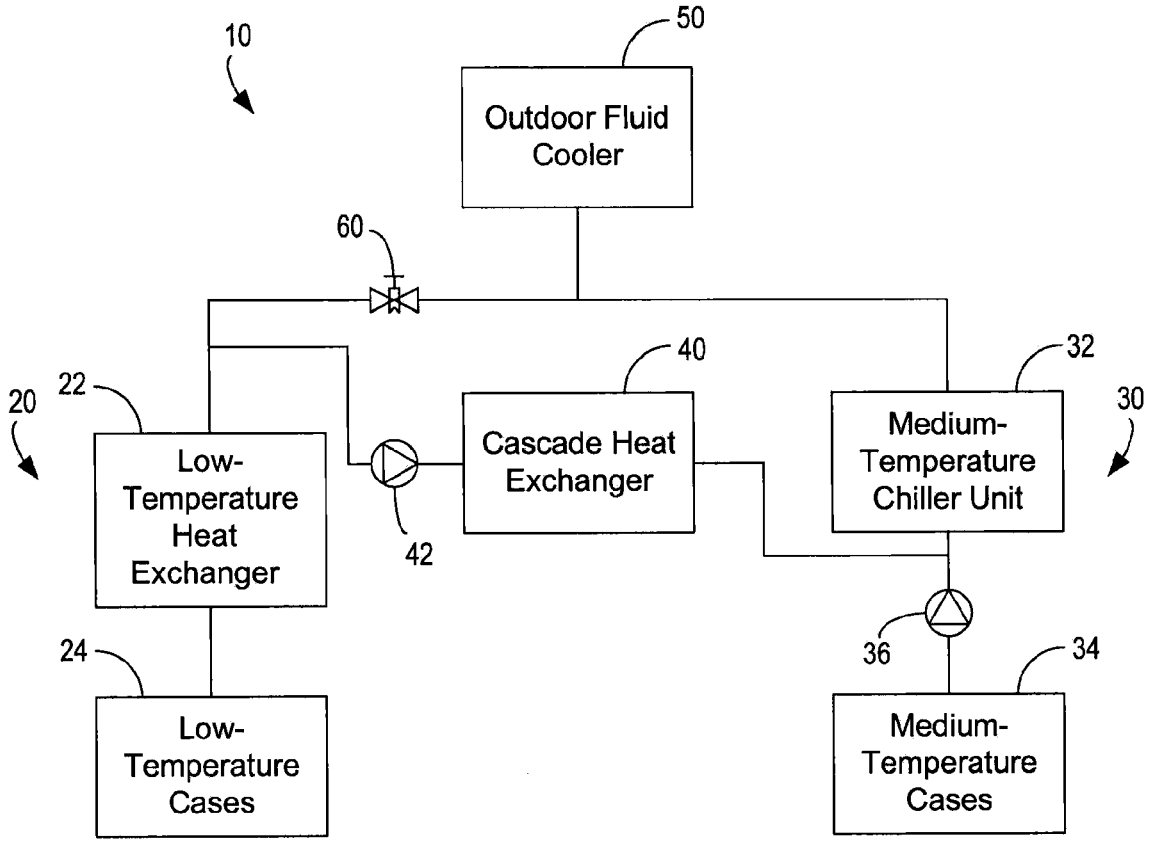
FIG. 1 is a simplified block diagram of a refrigeration system according to an exemplary including an outside fluid cooler that may selectively provide cooling for a low temperature refrigeration loop.

Referring to FIG. 1, a refrigeration system 10 is shown according to an exemplary embodiment. Refrigeration systems 10 typically include a refrigerant (e.g., a vapor compression/expansion type refrigerant, etc.) that circulates through a series of components in a closed system to maintain a cold region (e.g., a region with a temperature below the temperature of the surroundings). The refrigeration system 10 of FIG. 1 includes several subsystems or loops.

A first or low temperature subsystem 20 includes a low temperature heat exchanger 22 (e.g. condenser, etc.), and one or more low temperature cases 24 (e.g., refrigerated display cases, etc.). A low temperature coolant or refrigerant (e.g. carbon dioxide, ammonia, etc.) may be circulated between heat exchanger 22 and cases 24 in a closed loop cooling or refrigeration circuit to maintain cases 24 at a relatively low temperature.

A second or medium temperature subsystem 30 includes a medium temperature chiller 32, one or more medium temperature cases 34 (e.g., refrigerated display cases), and a pump 36. Pump 36 circulates a medium temperature liquid coolant (e.g., propylene glycol at approximately 20° F.) between chiller 32 and cases 34 to maintain cases 34 at a relatively medium temperature.

Medium temperature chiller 32 removes heat energy from medium temperature cases 34 and, in turn, gives the heat energy up to a heat exchanger, such as an outdoor fluid cooler 50 or outdoor cooling tower to be dissipated to the exterior environment. Medium temperature chiller 32 is further coupled to a cascade heat exchanger 40 to provide a source of coolant to the cascade heat exchanger.

Low temperature heat exchanger 22 receives heat energy from a low temperature cases 24 (e.g. directly from a liquid coolant that has been warmed in cases 24, or from a refrigerant circulating in a vapor-compression, direct-expansion refrigeration loop between an evaporator in cases 24, a compressor (not shown) and heat exchanger 22 (which may act as a condenser). Low temperature heat exchanger 22 may be coupled to either cascade heat exchanger 40 or fluid cooler 50. A valve 60 that is provided between low temperature subsystem 20 and fluid cooler 50, and a pump 42 provided between low temperature subsystem 20 and cascade heat exchanger 40, serve to determine to which component the low temperature heat exchanger 22 is coupled. In a normal operation or cascade mode, valve 60 is closed and pump 42 is activated, coupling low temperature heat exchanger 22 to cascade heat exchanger 40. However, if the exterior temperature is low enough, system 10 may enter a free cooling mode. In a free cooling mode, pump 42 is turned off and valve 60 is opened, coupling low temperature heat exchanger 22 to fluid cooler 50.

The terms "low temperature" and "medium temperature" are used herein for convenience to differentiate between two subsystems of refrigeration system 10. Low temperature system 20 maintains one or more cases 24 such as freezer display cases or other cooled areas at a temperature lower than the ambient temperature. Medium temperature system 30 maintains one or more cases 34 such as refrigerator cases or other cooled areas at a temperature lower than the ambient temperature but higher than low temperature cases 24. According to one exemplary embodiment, low temperature cases 24 may be maintained at a temperature of approximately minus (−) 20° F. and medium temperature cases 34 may be maintained at a temperature of approximately 20° F. Although only two subsystems are shown in the exemplary embodiments described herein, according to other exemplary refrigeration system 10 may include more subsystems that may be selectively cooled in a cascade arrangement or in a free cooling arrangement.

Figure 2:
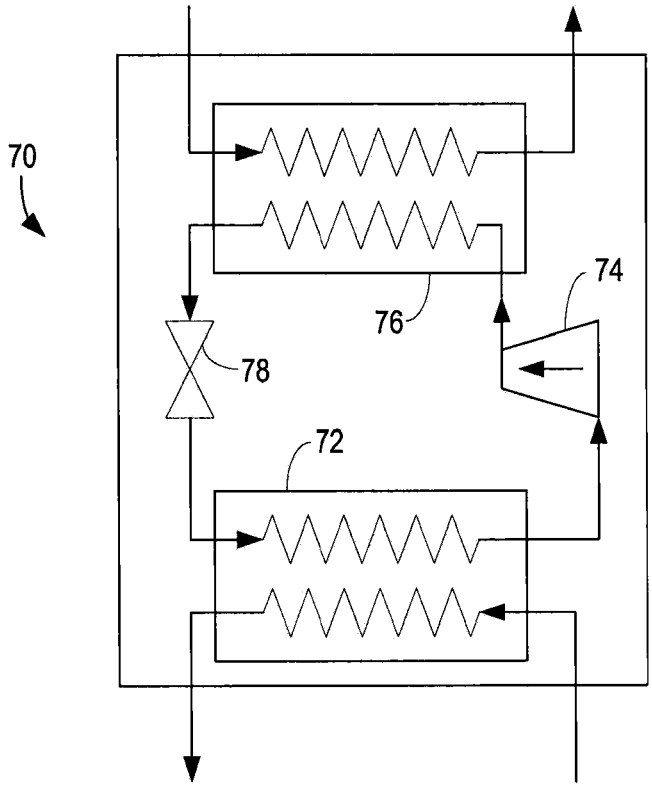
FIG. 2 is a block diagram of chiller unit of the system of FIG. 1 according to one exemplary embodiment.

One exemplary chiller unit 70 is shown in FIG. 2 and may be of a type used for a medium temperature chiller 32. Chiller unit 70 includes a refrigerant that is circulated through a vapor-compression refrigeration cycle including a first heat exchanger 72, a compressor 74, a second heat exchanger 76, and an expansion valve 78. In the first heat exchanger 72, the refrigerant absorbs heat from an associated display case(s) or other cooled area via a coolant circulated by a pump (e.g. pump 36 for medium temperature cases, etc.). In the second heat exchanger 76 (e.g. condenser, etc.), the refrigerant gives up heat to a second coolant. The second coolant, in turn, gives up heat to the exterior environment. Various elements of the chiller unit 70 may be combined. For example, heat exchangers 72 and 76 may comprise a single device in one exemplary chiller unit 70.

Figure 3:
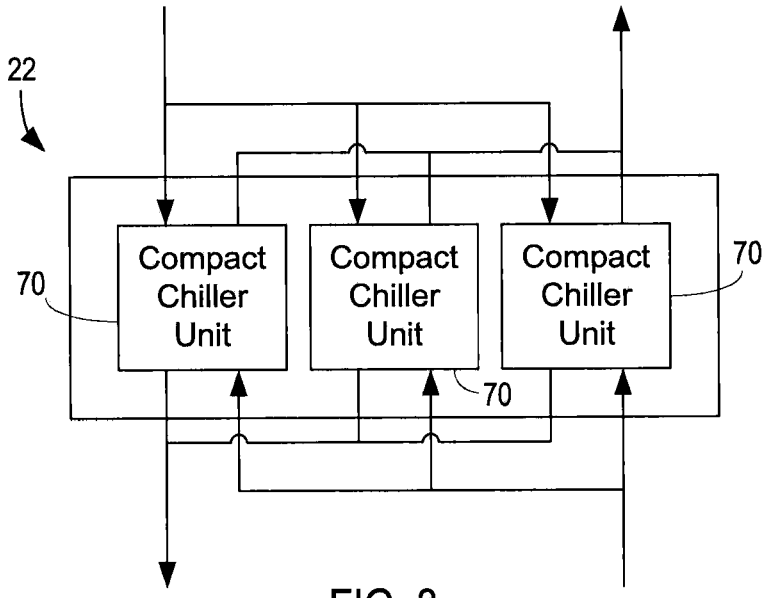
FIG. 3 is a block diagram of an assembly of the chiller units of FIG. 2 arranged in parallel.

According to one exemplary embodiment, chiller unit 70 is a compact modular chiller unit. As shown in FIG. 3, medium temperature chiller 32 may include a multitude of chiller units 70 arranged in parallel. The number of chiller units 70 may be varied to accommodate various cooling loads associated with a particular system.

Figure 4:
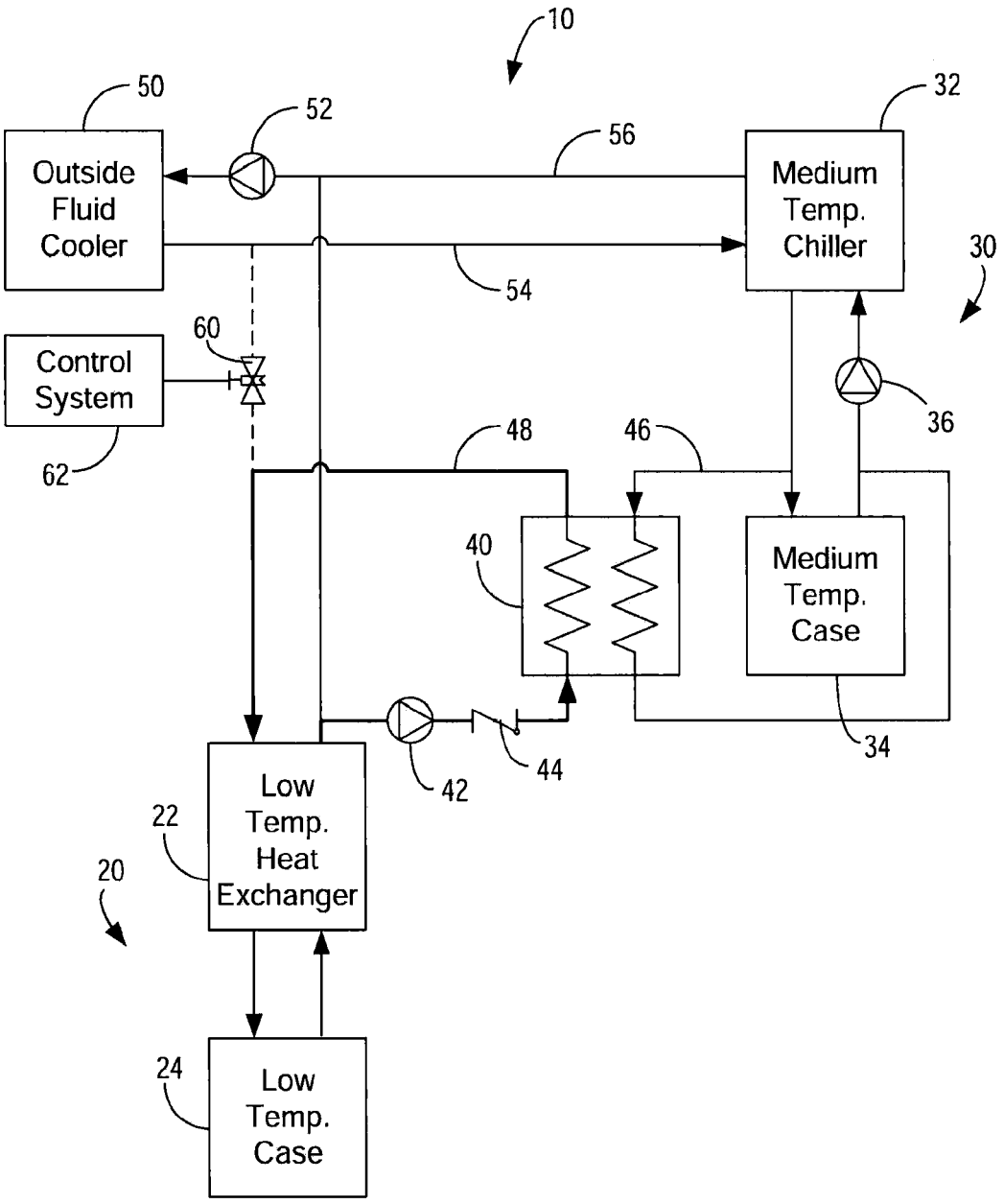
FIG. 4 is a block diagram of a refrigeration system according to one exemplary embodiment in a normal or cascade cooling arrangement.
Figure 5:
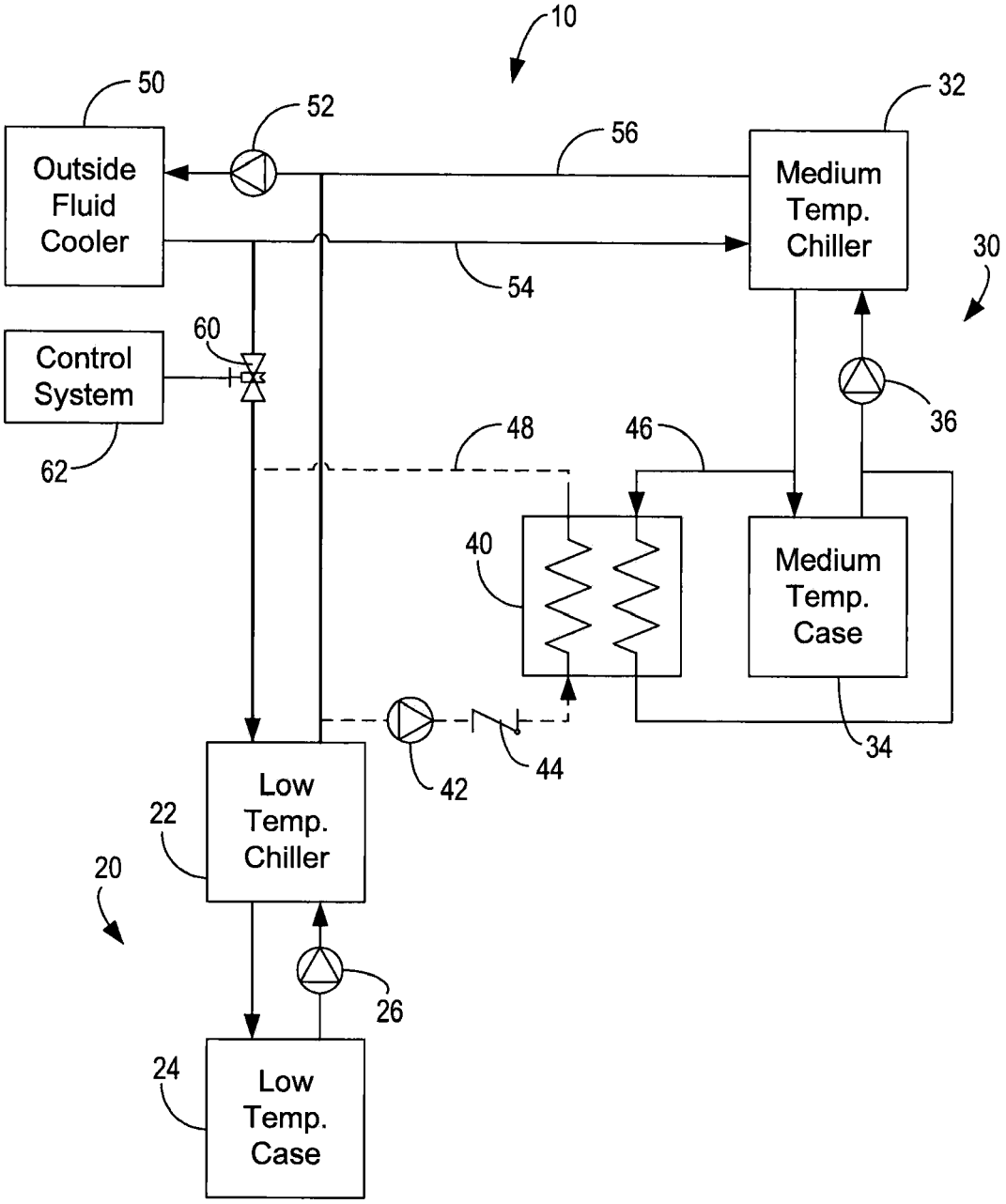
FIG. 5 is a block diagram of the refrigeration system of FIG. 4 in a free cooling arrangement.

Referring now to FIGS. 4 and 5, a refrigeration system 10 is shown according to one exemplary embodiment in a cascade mode (FIG. 4) and a free cooling mode (FIG. 5). Refrigeration system 10 includes a low temperature subsystem 20, a medium temperature subsystem 30, a cascade heat exchanger 40, a fluid cooler 50, and a valve 60 that selectively couples low temperature subsystem 20 to fluid cooler 50.

Fluid cooler 50 is shown to be provided outside a building where it is exposed to the outside air (e.g. at ambient temperature, etc.). Fluid cooler 50 uses the outside air to cool a coolant (e.g. a condenser coolant such as water, etc.) that flows through a condenser cooling circuit for refrigeration system 10. Fluid cooler 50 is coupled to a condenser coolant supply header 54 and a condenser coolant suction header 56. Flow through fluid cooler 50 is provided by a pump 52 located, for example, in-line with suction header 56. Medium temperature subsystem 30 is cooled by fluid cooler 50 in all modes and fluid is circulated through medium temperature chiller 32 via supply header 54 and suction header 56. Low temperature subsystem 20 is likewise coupled to supply header 54 and suction header 56 with valve 60 provided between low temperature heat exchanger 22 and fluid cooler 50.

Cascade heat exchanger 40 is coupled to both low temperature subsystem 20 and medium temperature subsystem 30. According to an exemplary embodiment, one side of cascade heat exchanger 40 is connected to a first loop 46 that is coupled in parallel with medium temperature cases 34 to medium temperature chiller 32 (e.g., on the first heat exchanger 72 side of chiller 32). A second side of exchanger 40 is connected to a second loop 48 that is coupled to low temperature heat exchanger 22 opposite of low temperature cases 24. A pump 42 is provided to circulate fluid through second loop 48 and a check valve 44. Fluid in first loop 46 is circulated by pump 36 of medium temperature subsystem 30.

Referring to FIG. 4, in a normal operation or cascade mode, valve 60 is moved to a closed position that defines two flow paths, and pump 42 is activated. In the first flow path, low temperature heat exchanger 22 is coupled to cascade heat exchanger 40 and pump 42 to provide a cascade condenser cooling loop for the low temperature system 20. In the second flow path, medium temperature chiller 32 is coupled to fluid cooler 50 and pump 52 to provide a condenser cooling loop for the medium temperature chillers. While valve 60 is closed, isolating low temperature heat exchanger 22 from supply header 54, a small amount of fluid may still mix with the fluid in suction header 56 (e.g. fluid flowing from medium temperature chiller 32 to condenser pumps 52). Fluid in second loop 48 passes through low temperature heat exchanger 22 and is heated, carrying heat energy absorbed from low temperature cases 24 to cascade heat exchanger 40. In heat exchanger 40 fluid in second loop 48 thus heats fluid in first loop 46. Fluid in first loop 46 joins heated fluid from medium temperature cases 34 and is cooled by medium temperature chiller 32 before returning to cascade heat exchanger 40.

If the outside temperature is sufficiently cold (e.g., below 60° F.), refrigeration system 10 may be converted to a "free cooling" mode as shown in FIG. 5. In the free-cooling mode valve 60 is moved to the open position to define a third flow path that provides condenser cooling for both the medium temperature chillers 32 and the low temperature heat exchangers 22 from fluid cooler 50 and bypasses the cascade heat exchanger 40 by turning pump 42 off and any back flow through second loop 48 is halted by check valve 44. In the third flow path, pumps 52 circulate the fluid (e.g. condenser coolant) through the fluid cooler 50 and then to the heat exchanger 22 in the low temperature system 20 and to the condenser within the medium temperature chillers 32. The fluid passes through low temperature heat exchanger 22 and is heated, carrying heat energy absorbed from low temperature system 20 to suction header 56. Pump 52 then pumps the fluid to fluid cooler 50 where it is cooled by the outside air before returning in a condensing loop to supply header 54 and then to low temperature heat exchanger 22. Bypassing cascade heat exchanger 40 places a smaller load on medium temperature chillers 32 and takes advantage of the relatively low-cost cooling provided by outside fluid cooler 50.

The operation of valve 60 and pump 42 is controlled by a control system 62. Control system monitors the outside conditions (e.g., temperature, relative humidity, etc.) and determines whether refrigeration system 10 functions in a cascade mode or a free cooling mode by operating valve 60 and pump 42.

Figure 6:
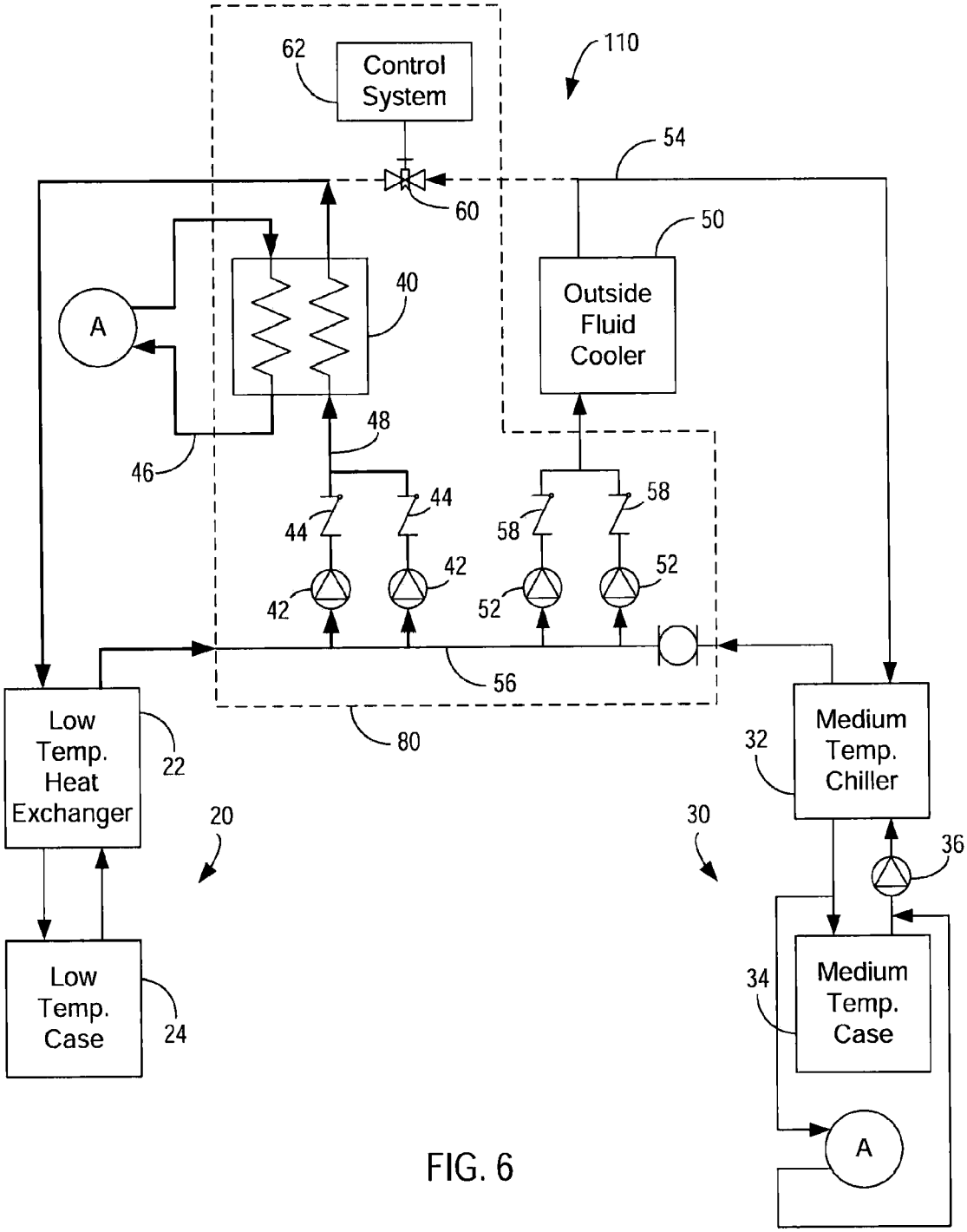
FIG. 6 is a block diagram of a refrigeration system according to another exemplary embodiment in a normal or cascade cooling arrangement.
Figure 7:
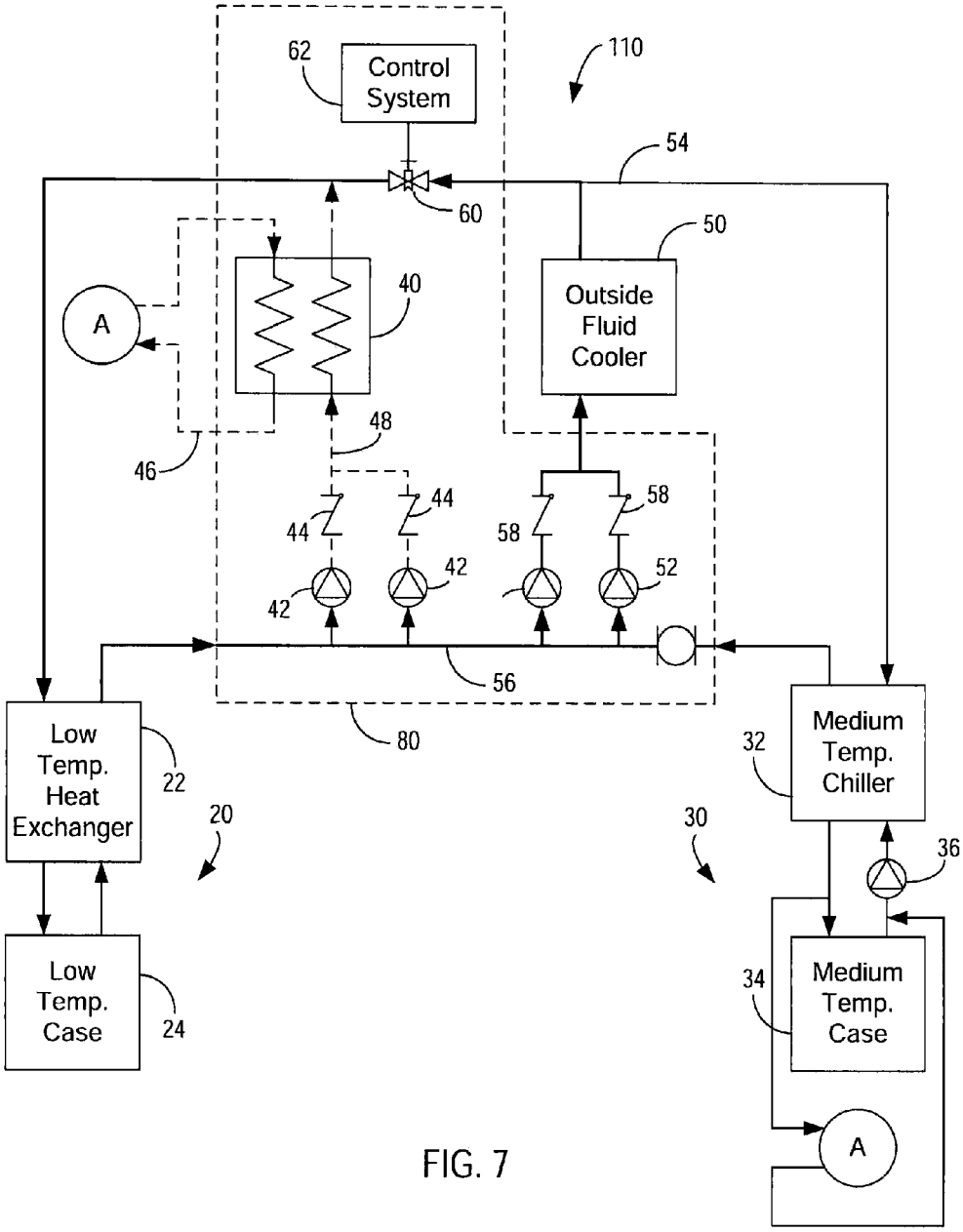
FIG. 7 is a block diagram of the refrigeration system of FIG. 6 in a free cooling arrangement.

Referring now to FIGS. 6 and 7, a refrigeration system 110 is shown according to another exemplary embodiment in a cascade mode (FIG. 6) and a free cooling mode (FIG. 7). Refrigeration system 110 may be, for example, an existing system that is retrofitted to incorporate the advantages described above. Refrigeration system 110 includes a low temperature subsystem 20, a medium temperature subsystem 30, a fluid cooler 50, and a pump station 80. Pump station 80 includes a cascade heat exchanger 40, cascade pumps 42, condenser pumps 52, and a valve 60 that selectively couples low temperature subsystem 20 to fluid cooler 50 for operation in a free-cooling mode.

Fluid cooler 50 is typically provided outside a building (e.g. food retail outlet, etc.) where it is exposed to the outside air. Fluid cooler 50 uses the outside air to cool a coolant for refrigeration system 110. Fluid cooler 50 is coupled to a common supply header 54 and a common suction header 56. Flow through fluid cooler 50 is provided by a one or more condenser pumps 52. As shown in FIGS. 6 and 7, two or more condenser pump 52 and check valve 58 pairs may be arranged in parallel and be coupled to common suction header 56. Medium temperature subsystem 30 is cooled by fluid cooler 50 in all modes and fluid passes through medium temperature chiller 32 via supply header 54 and suction header 56. Low temperature subsystem 20 is likewise coupled to a condensing loop including supply header 54 and suction header 56 with valve 60 provided between low temperature heat exchanger 22 and fluid cooler 50.

Cascade heat exchanger 40 is coupled to both low temperature subsystem 20 and medium temperature subsystem 30. According to an exemplary embodiment, one side of heat exchanger 40 is connected to a first loop 46 that is coupled in parallel with medium temperature cases 34 to medium temperature chiller 32 (e.g., on the first heat exchanger 72 side of chiller 32). A second side of cascade heat exchanger 40 is connected to a second loop 48 that is coupled to low temperature heat exchanger 22 which may serve as a condenser for condensing a refrigerant (e.g. carbon dioxide, ammonia, etc.) circulating in a closed loop vapor-compression, direct-expansion circuit in the low temperature subsystem 20 through low temperature cases 24. Alternatively, heat exchanger 22 may be configured as a chiller (such as a chiller 70 as shown in FIG. 2) to provide cooling to a liquid coolant (e.g. liquid carbon dioxide, etc.) circulating via a pump 26 in a loop of the low temperature subsystem 20 between heat exchanger 22 and cases 24 (see FIG. 5). Cascade heat exchanger 40 includes one or more cascade pumps 42 to circulate fluid (e.g. water or other suitable coolant) through second loop 48 and check valve 44. As shown in FIGS. 6 and 7, two or more cascade pump 42 and check valve 44 pairs may be arranged in parallel and be coupled to common suction header 56. According to the illustrated embodiment, fluid in first loop 46 is circulated by pump 36 of medium temperature subsystem 30.

Referring to FIG. 6, in a normal operation or cascade mode, valve 60 is closed and pumps 42 are activated, thus coupling low temperature heat exchanger 22 to cascade heat exchanger 40. While valve 60 is closed, isolating low temperature heat exchanger 22 from supply header 54, a small amount of fluid may still mix with the fluid in suction header 56 (e.g. fluid flowing from medium temperature chiller 32 to condenser pumps 52). Fluid in second loop 48 passes through low temperature heat exchanger 22 and is heated, carrying heat energy absorbed from low temperature subsystem 20 to cascade heat exchanger 40. In heat exchanger 40, fluid in second loop 48 heats the fluid in first loop 46. Fluid in first loop 46 joins heated fluid from medium temperature cases 34 and is cooled by medium temperature chiller 32 before returning to cascade heat exchanger 40.

If the outside temperature is sufficiently cold (e.g., below 60° F. or other suitable temperature as determined by system operating requirements), refrigeration system 110 may be converted to a free cooling mode as shown in FIG. 7. Valve 60 is opened, thus coupling low temperature heat exchanger 22 to fluid cooler 50. Pumps 42 are turned off and any back flow through second loop 48 is halted by check valves 44. Fluid passes through low temperature heat exchanger 22 and is heated, carrying heat energy absorbed from low temperature subsystem to suction header 56. Pumps 52 then circulate the fluid to fluid cooler 50 where it is cooled by the outside air before returning in a condensing loop including supply header 56 and then to low temperature heat exchanger 22. Bypassing cascade heat exchanger 40 places a smaller load on medium temperature chillers 32 and takes advantage of the relatively low-cost cooling provided by outside fluid cooler 50.

The operation of valve 60 and pump 42 is controlled by a control system 62. Control system monitors the outside conditions (e.g., temperature, relative humidity, etc.) and determines whether refrigeration system 110 functions in a cascade mode or a free cooling mode by operating valve 60 and pump 42.

It is important to note that the construction and arrangement of the elements of the refrigeration system provided herein are illustrative only. Although only a few exemplary embodiments of the present invention(s) have been described in detail in this disclosure, those skilled in the art who review this disclosure will readily appreciate that many modifications are possible in these embodiments (such as variations in features such as connecting structure, components, materials, sequences, capacities, shapes, dimensions, proportions and configurations of the modular elements of the system, without materially departing from the novel teachings and advantages of the invention(s). For example, any number of chiller units may be provided in parallel to cool the low temperature and medium temperature cases, or more subsystems may be included in the refrigeration system (e.g., a very cold subsystem or additional cold or medium subsystems). Further, it is readily apparent that variations and modifications of the refrigeration system and its components and elements may be provided in a wide variety of materials, types, shapes, sizes and performance characteristics. Accordingly, all such variations and modifications are intended to be within the scope of the invention(s).

What is claimed is:

1. A refrigeration system, comprising:

a plurality of medium temperature heat exchangers arranged in parallel and configured to cool a medium temperature coolant for circulation in a first closed loop between the medium temperature heat exchangers and a plurality of medium temperature refrigerated display cases;

a plurality of low temperature heat exchangers arranged in parallel and configured to cool a low temperature coolant for circulation in a second closed loop between the low temperature heat exchangers and a plurality of low temperature refrigerated display cases;

a condenser coolant supply header configured to supply a condenser coolant to the low and medium temperature heat exchangers;

a condenser coolant suction header configured to receive the condenser coolant from the low and medium temperature heat exchangers;

a fluid cooler configured to cool the condenser coolant in the condenser coolant supply header;

a cascade heat exchanger separate from the medium temperature heat exchangers and arranged in parallel with the medium temperature refrigerated display cases along the first closed loop such that the medium temperature heat exchangers provide a supply of the medium temperature coolant to both the cascade heat exchanger and the medium temperature refrigerated display cases in parallel;

at least one first pump configured to pump the condenser coolant from the condenser coolant suction header to the coolant supply header and through the fluid cooler;

at least one second pump configured to pump the condenser coolant from the coolant suction header to the condenser coolant supply header and through the cascade heat exchanger;

a valve disposed on the condenser coolant supply header between the low temperature heat exchangers and the fluid cooler, the valve movable to a closed position to define a first cooling flow path comprising the first pump and the fluid cooler and the medium temperature heat exchangers, and a second cooling flow path comprising the second pump and the cascade heat exchanger and the low temperature heat exchangers;

wherein the cascade heat exchanger is configured to receive both the coolant from the low temperature heat exchangers and the supply of the medium temperature coolant from the medium temperature heat exchangers when the valve is closed and to cool the coolant from the low temperature heat exchangers using the supply of the medium temperature coolant from the medium temperature heat exchangers.

2. The refrigeration system of claim 1 wherein the medium temperature heat exchanger comprises a chiller for cooling a medium temperature liquid coolant circulating to the medium temperature refrigerated display cases.

3. The refrigeration system of claim 1 wherein the low temperature heat exchanger comprises a chiller for cooling a low temperature liquid coolant circulating to the low temperature refrigerated display cases.

4. The refrigeration system of claim 3 wherein the low temperature liquid coolant comprises liquid carbon dioxide.

5. The refrigeration system of claim 1 wherein the low temperature heat exchanger comprises a condenser and the low temperature coolant comprises a refrigerant.

6. The refrigeration system of claim 5 wherein the refrigerant comprises carbon dioxide or ammonia.

7. The refrigeration system of claim 1 wherein the first cooling flow path and the second cooling flow path share a common suction header between the first pump and the second pump.

8. The refrigeration system of claim 7 wherein the valve is movable to an open position to define a third flow path comprising the fluid cooler and the medium temperature heat exchangers and the low temperature heat exchangers.

9. The refrigeration system of claim 1 wherein the fluid cooler is an outdoor fluid cooler configured to use air at an ambient temperature to cool the coolant.

10. The refrigeration system of claim 9 further comprising a control system operable to close the valve when the ambient temperature is above a predetermined level, and to open the valve when the ambient temperature is below the predetermined level.

11. The refrigeration system of claim 8 wherein the second pump is turned on when the valve is in the closed position to circulate the coolant through the second flow path, and the second pump is turned off when the valve is open the open position so that the first pump circulates the coolant through the third flow path.

12. A refrigeration system, comprising:

at least one medium temperature chiller for cooling a medium temperature coolant circulated in a first closed loop between the medium temperature chiller and at least one medium temperature refrigerated display case;

at least one low temperature heat exchanger for cooling a low temperature coolant circulated in a second closed loop between the low temperature heat exchanger and at least one low temperature refrigerated display case;

a condenser coolant supply header configured to supply a condenser coolant to the medium temperature chiller and to the low temperature heat exchanger;

a condenser coolant suction header configured to receive the condenser coolant from the medium temperature chiller and from the low temperature heat exchanger;

a fluid cooler configured to receive and cool the condenser coolant;

a cascade heat exchanger separate from the medium temperature chiller and arranged in parallel with the medium temperature refrigerated display case along the first closed loop such that the medium temperature chiller provides a supply of the medium temperature coolant to both the cascade heat exchanger and the medium temperature refrigerated display case in parallel;

at least one condenser coolant pump configured to pump the condenser coolant from the condenser coolant suction header to the condenser coolant supply header and through the fluid cooler;

at least one cascade pump configured to pump the condenser coolant from the condenser coolant suction header to the condenser coolant supply header and through the cascade heat exchanger; and a valve movable to a closed position to define a first cooling flow path comprising the condenser pump and the fluid cooler and the medium temperature chiller, and a second cooling flow path comprising the cascade pump and the cascade heat exchanger and the low temperature heat exchanger;

wherein the cascade heat exchanger is configured to receive both the coolant from the low temperature heat exchanger and the supply of the medium temperature coolant from the medium temperature chiller when the valve is closed and to cool the coolant from the low temperature heat exchanger using the supply of the medium temperature coolant from the medium temperature chiller.

13. The refrigeration system of claim 12 wherein the first cooling flow path and the second cooling flow path share a common suction header between the condenser pump and the cascade pump.

14. The refrigeration system of claim 13 wherein the valve is movable to an open position to define a third flow path comprising the fluid cooler and the medium temperature chiller and the low temperature heat exchanger.

15. The refrigeration system of claim 12 wherein the fluid cooler is an outdoor fluid cooler configured to use air at an ambient temperature to cool the coolant.

16. The refrigeration system of claim 15 further comprising a control system operable to close the valve when the ambient temperature is above a predetermined level, and to open the valve when the ambient temperature is below the predetermined level.

17. The refrigeration system of claim 14 wherein the cascade pump is turned on when the valve is in the closed position to circulate the coolant through the second flow path, and the second pump is turned off when the valve is open the open position so that the first pump circulates the coolant through the third flow path.

18. A refrigeration system, comprising:

a medium temperature subsystem circulating a medium temperature coolant in a first closed loop between at least one medium temperature heat exchanger and at least one medium temperature load and at least one cascade heat exchanger separate from the medium temperature heat exchanger and arranged in parallel with the medium temperature load along the first closed loop such that the medium temperature heat exchanger provides the medium temperature coolant to both the cascade heat exchanger and the medium temperature load in parallel;

a low temperature subsystem circulating a low temperature coolant in a second closed loop between at least one low temperature heat exchanger and at least one low temperature load;

a condenser cooling circuit for circulating a condenser coolant, the condenser cooling circuit having a first pump and a second pump and a fluid cooler and a valve, and interfacing with the medium temperature heat exchanger and the low temperature heat exchanger;

wherein the valve is movable to a closed position defining a first flow path and a second flow path, the first flow path including the first pump and the medium temperature heat exchanger and fluid cooler and the second flow path including the second pump and the low temperature heat exchanger and the cascade heat exchanger;

wherein the cascade heat exchanger is configured to receive both the coolant from the low temperature heat exchanger and the medium temperature coolant from the medium temperature heat exchanger when the valve is closed and to cool the coolant from the low temperature heat exchanger using the medium temperature coolant from the medium temperature heat exchanger.

19. The refrigeration system of claim 18 wherein the medium temperature heat exchanger comprises a chiller for cooling a medium temperature liquid coolant circulating to the medium temperature load.

20. The refrigeration system of claim 18 wherein the low temperature heat exchanger comprises a chiller for cooling a low temperature liquid coolant circulating to the low temperature load.

21. The refrigeration system of claim 20 wherein the low temperature liquid coolant comprises liquid carbon dioxide.

22. The refrigeration system of claim 18 wherein the low temperature heat exchanger comprises a condenser and the low temperature coolant comprises a refrigerant.

23. The refrigeration system of claim 22 wherein the refrigerant comprises carbon dioxide or ammonia.

24. The refrigeration system of claim 18 wherein the valve is movable to an open position to define a third flow path comprising the fluid cooler and the medium temperature heat exchanger and the low temperature heat exchanger.

25. The refrigeration system of claim 24 further comprising a control system operable to actuate the valve between the open position and the closed position based on a signal representative of an air temperature proximate the fluid cooler.

26. The refrigeration system of claim 24 wherein the valve is disposed in the cooling circuit between the low temperature chiller and the fluid cooler.

* * * * *